US011470967B2

(12) United States Patent
Ostertag et al.

(10) Patent No.: US 11,470,967 B2
(45) Date of Patent: Oct. 18, 2022

(54) PLATFORM AND LEVELING SYSTEM FOR A MECHANICAL DEVICE

(71) Applicants: Erik A. Ostertag, Hastings, MN (US); Erik G. Swenson, Orono, MN (US)

(72) Inventors: Erik A. Ostertag, Hastings, MN (US); Erik G. Swenson, Orono, MN (US)

( * ) Notice: Subject to any disclaimer, the term of this patent is extended or adjusted under 35 U.S.C. 154(b) by 0 days.

(21) Appl. No.: 16/947,588

(22) Filed: Aug. 7, 2020

(65) Prior Publication Data

US 2021/0037974 A1 Feb. 11, 2021

Related U.S. Application Data

(60) Provisional application No. 62/883,844, filed on Aug. 7, 2019.

(51) Int. Cl.
*F16M 13/00* (2006.01)
*A47B 91/16* (2006.01)
*A47B 91/02* (2006.01)

(52) U.S. Cl.
CPC ..... *A47B 91/16* (2013.01); *A47B 91/02* (2013.01)

(58) Field of Classification Search
None
See application file for complete search history.

(56) References Cited

U.S. PATENT DOCUMENTS 1,125,668 A * 1/1915 Deming ..... A47B 91/024 248/188.4
3,659,814 A * 5/1972 Rode ..... F16M 7/00 248/649
4,207,699 A * 6/1980 Hensley ..... F41A 23/00 42/94
4,949,923 A * 8/1990 Daily ..... F16M 7/00 248/188.3
6,302,543 B1 * 10/2001 Arai ..... H04N 9/3141 248/157
6,883,263 B1 * 4/2005 Carrow ..... F41A 23/14 248/178.1
6,923,419 B2 * 8/2005 George ..... A47B 91/005 248/188.4
7,124,772 B1 * 10/2006 Browning ..... G08B 21/20 137/312

* cited by examiner

*Primary Examiner* — Steven M Marsh

(57) ABSTRACT

A pad includes a support structure for supporting a mechanical device. The support structure includes a horizontal layer supported by vertical members. The pad also includes a leveling mechanism for leveling the pad. The leveling mechanism can include first, second, third and fourth leveling legs near a first, second, third and fourth corner, respectively of the pad. The leveling legs can be screwed into or out of the pad such that during installation of the mechanical device, an installer can level the pad by screwing in or out the first, second, third and fourth leveling legs until the pad is level.

10 Claims, 5 Drawing Sheets

PLATFORM AND LEVELING SYSTEM FOR A MECHANICAL DEVICE

TECHNICAL FIELD

The present invention generally relates to a platform having a leveling system for supporting a mechanical device.

BACKGROUND

Typically, mechanical devices such as furnaces, air handlers and other equipment are installed on the floor of a utility room. Because the utility room typically includes a floor drain, the floor within the room is sloped to drain towards the floor drain. As such, the floor is not level; however, the mechanical device, i.e. furnace needs to be installed level. Spacers, such as bricks, rocks, shims, etc. are typically used to level the furnace by appropriately putting spacers under the corner(s) that needs to be raised to level the furnace. However, the furnace is usually placed in between other mechanical equipment, such as an air cleaner, another furnace, a water heater, etc. As such, the space around the furnace is usually very tight. It is therefore difficult to level the rear of the furnace because the space is usually too tight to reach the rear of the furnace once the furnace is put in place. Installers typically try to approximate what would make the furnace level by placing a block under a rear corner and then placing the furnace on top and checking for level. Often, the furnace then will need to be removed to re-level, which becomes a trial and error process that is time consuming, error prone and tedious. Therefore, improvements are desirable.

SUMMARY

In one aspect of the present disclosure, a pad includes a support structure for supporting a mechanical device. The support structure includes a horizontal layer supported by vertical members. The pad also includes a leveling mechanism for leveling the pad such that during installation of the mechanical device, an installer can level the pad.

In another aspect, a pad includes a support structure for supporting a mechanical device. The support structure includes a horizontal layer supported by vertical members. The pad also includes a leveling mechanism for leveling the pad. The leveling mechanism includes first, second, third and fourth leveling legs near a first, second, third and fourth corner, respectively of the pad. The leveling legs can be screwed into or out of the pad such that during installation of the mechanical device, an installer can level the pad by screwing in or out the first, second, third and fourth leveling legs until the pad is level.

In another aspect, a pad includes a support structure for supporting a mechanical device. The support structure includes a horizontal layer supported by vertical members. The pad also includes a leveling mechanism for leveling the pad. The leveling mechanism includes first, second, third and fourth leveling legs near a first, second, third and fourth corner, respectively of the pad. During installation of the mechanical device, an installer can level the pad by using the leveling legs.

The foregoing has outlined rather broadly the features and technical advantages of the present invention in order that the detailed description of the invention that follows may be better understood. Additional features and advantages of the invention will be described hereinafter that form the subject of the claims of the invention. It should be appreciated by those skilled in the art that the concepts and specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features that are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the disclosed system and methods, reference is now made to the following descriptions taken in conjunction with the accompanying drawings.

DETAILED DESCRIPTION

In general, a platform, or pad, with a leveling mechanism is disclosed. The pad is shaped and sized to fit under a mechanical device, such as a furnace, air handler or air conditioner, and configured to support the weight of the mechanical device. Preferably, the pad includes a leveling mechanism that allows the pad to be leveled while in place. For example, the pad could have four leveling legs—one at each corner. Preferably, the leveling mechanism would also allow the four corners of the pad to be leveled independently. Other configurations are also possible. For example, the pad may only have leveling legs at the front of the pad. The leveling mechanism could also have other leveling devices, such as angled blocks that slide relative to one another or have a rocker at the back that would allow the back to self-level while having leveling legs at the front. It is also possible that the leveling legs could be optional and used as needed to save cost and/or weight. If the floor the pad is installed on is level, the leveling mechanism would not be needed. For example, the legs could be press fit into the pad when necessary or removed when unnecessary.

Figure 1:
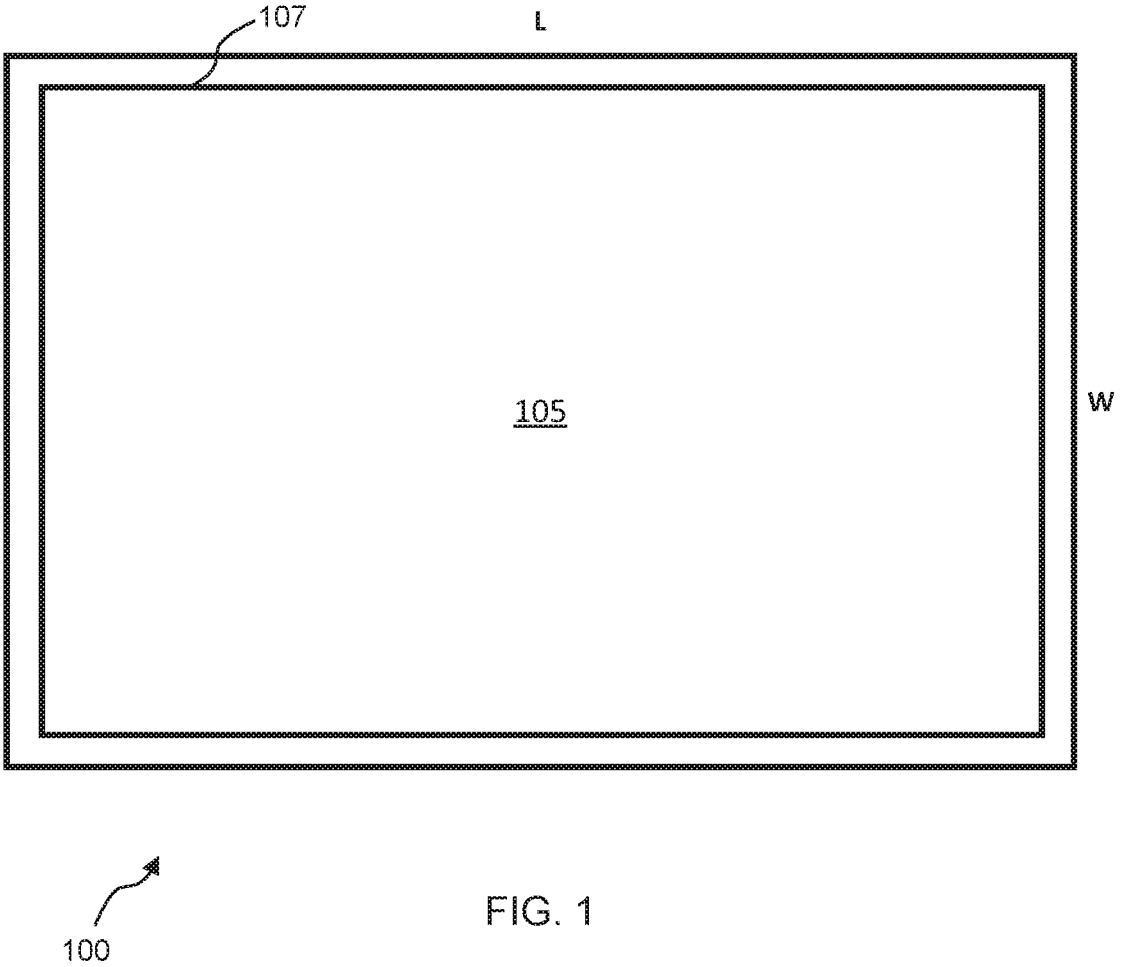
FIG. 1 is a top view diagram of a pad according to one example embodiment of the present disclosure.

Turning now to the figures, FIG. 1 is a top view of a pad 100. Generally, the pad 100 is sized to fit under a mechanical device, such as a furnace. The pad 100 could be any size, but preferably a length L of the pad 100 is between 20 inches and 40 inches, and typically is 29¾ inches. Preferably a width W of the pad 100 is between 20 inches and 30 inches, and typically is 24 inches. The pad 100 has a top surface 105. The top surface 105 could additionally have a covering 107 over it, which can have some acoustic insulation properties to help reduce vibration from the furnace and absorb sound. For example, the covering 107 could be a rubber or foam pad. The top surface 105 could also have a small lip to help hold the covering 107 in place and keep the furnace from vibrating off the pad 100. Preferably the pad is made of a plastic material but could be manufactured from any variety of suitable materials.

Figure 2:
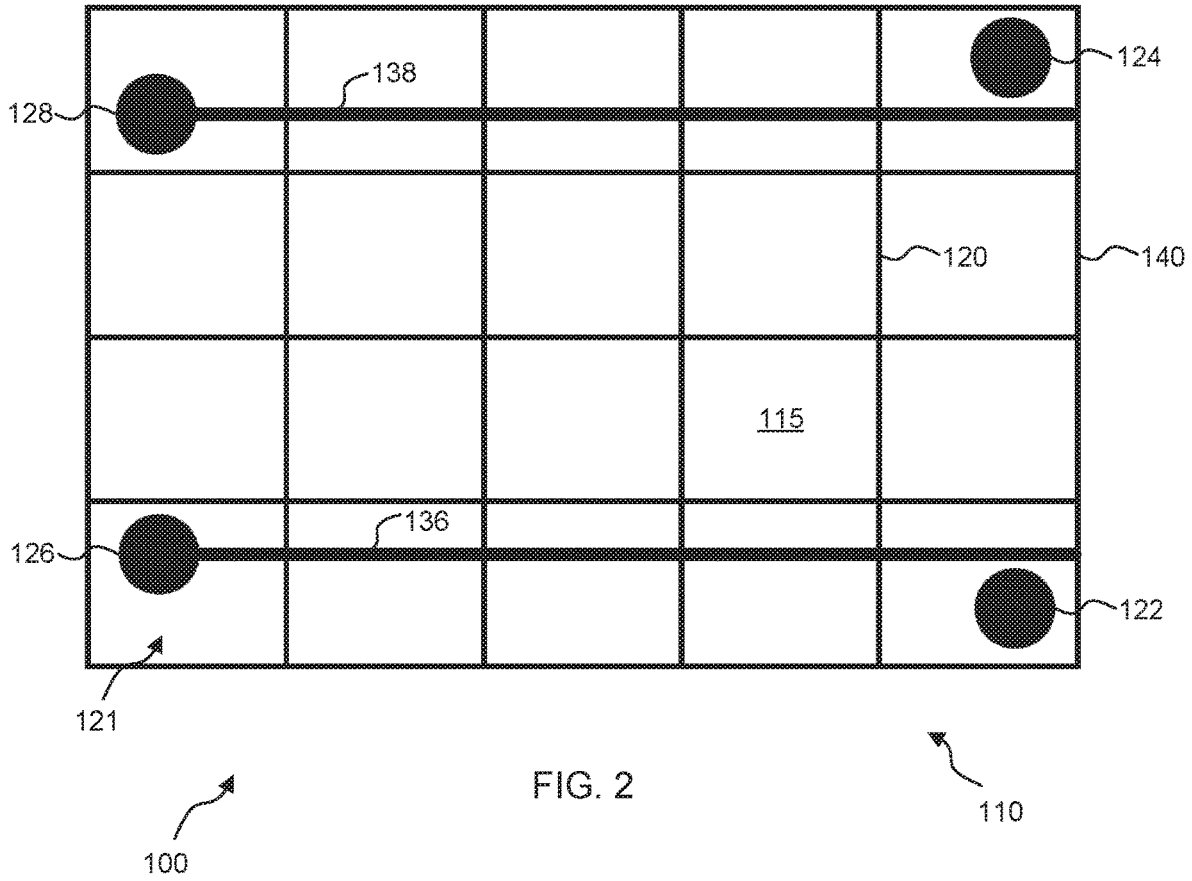
FIG. 2 is a bottom view diagram of the pad of FIG. 1, according to one example embodiment of the present disclosure.

Referring now to FIG. 2, FIG. 2 is a bottom view of the pad 100. The pad 100 has a support structure 110 under the top surface 105 that is designed to support the weight of the mechanical device while still remaining relatively lightweight for ease of use. According to the example embodiment shown in FIG. 2, the support structure 110 consists of a horizontal layer 115 supported by vertical layers 120 arranged in a waffle like pattern to give rigidity to the pad 100. Of course any number of structural configurations are possible. It is noted that most of the weight of a furnace is around the periphery of the furnace. As such the support structure 110 could be made to carry the bulk of the weight around the periphery of the pad 100 rather than the center.

Figure 3:
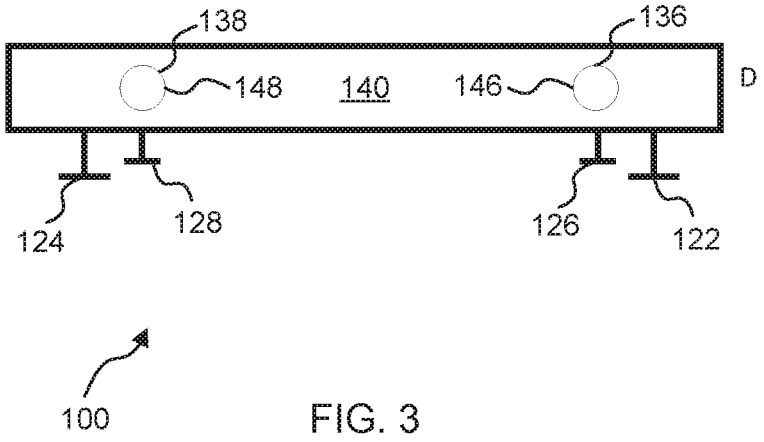
FIG. 3 is a front view diagram of the pad of FIGS. 1 and 2, according to one example embodiment of the present disclosure.

The pad 100 also has a leveling mechanism 121. Preferably, the leveling mechanism 121 has first and second front legs 122, 124 and first and second rear legs 126, 128. The leveling legs 122, 124, 126, 128 are fitted within the support structure 110 but are designed to extend down below the support structure 110 as shown in FIG. 3. The leveling mechanism 121 could be integral with the pad 100, removable from the pad 100 or press fitted into the pad 100 when necessary. Not all installations require the pad 100 to be leveled. Therefore, it is considered that the leveling mechanism could be an accessory to the pad 100. As such, the cost and weight could be reduced when the leveling mechanism is not needed.

The leveling mechanism 121 is used during installation to help level the pad 100 on an uneven floor. Preferably, the front legs 122, 124 are standard screw down/up legs found on most appliances and other devices for leveling. These legs could be made of plastic, metal or other suitable material. The legs could also be press fitted into place by, for example, having a hex pocket in the pad for press fitting a nut into the hex pocket. The screw legs would then screw into the nut once it is retained in the hex pocket. The legs could also be a separate module that is press fitted in the pad 100.

During installation, the rear legs 126, 128 are harder to reach due to space restrictions in most mechanical or utility rooms. Therefore, as shown, the rear legs 126, 128 have horizontal leveling rods 136, 138, respectively. Typically, these rods 136, 138 are screws that interact with the rear legs 126, 128 to turn the rear legs up and down such that the front and rear can be leveled from the front 140 of the pad 100.

Referring to FIG. 3, FIG. 3 is a front view of the pad 100. The front legs 122, 124 are shown. The rear legs 126, 128 are also shown. The horizontal rods 136, 138 are also shown. Preferably, the rods 136, 138 can be turned from the front 140 of the pad 100 to cause the rear legs 126, 128, respectively to move up and down as desired. As such, an installer can level all four legs 122, 124, 126, 128 from the front side of the pad 100 without a need to reach the rear side of the pad 100. The rods 136, 138 include some sort of end cap 146, 148, respectively, such as a Phillips head, or socket head, that would allow the installer to turn the rods 136, 138, respectively with some tool.

In practice, the installer would level the front legs 122, 124 by hand and use a tool to turn the end caps 146, 148 one way or another causing the rods 136, 138, respectively, to corresponding spin. The rods 136, 138 would then interact with the rear legs 126, 128, respectively, to go up or down as desired. Alternatively, the front legs 122, 124 could also have a mechanism to cause them to go up or down with a tool to further ease installation and time of installation. The support structure 110 of the pad 100 has a depth of between 1 and 3 inches, and typically is 2 inches. The leveling legs 122, 124, 126, 128 extend down from the bottom of the pad, for example ½" below the bottom of the pad. In the case of manual legs, this allows room for the pad to raise or lower by turning the screw in or out.

The leveling mechanism 121 of FIGS. 2 and 3 could have alternative designs. For example, angular friction blocks that slide with regard to one another could also be used. A self-leveling rocker mechanism could also be used. Many different configurations are possible. It is also possible that one or more of the corners of the pad 100 have a different leveling mechanism 121. For example, the rear corners of the leveling mechanism 121 could have friction blocks while the front corners of the leveling mechanism 121 have manual screw down legs.

Figure 4:
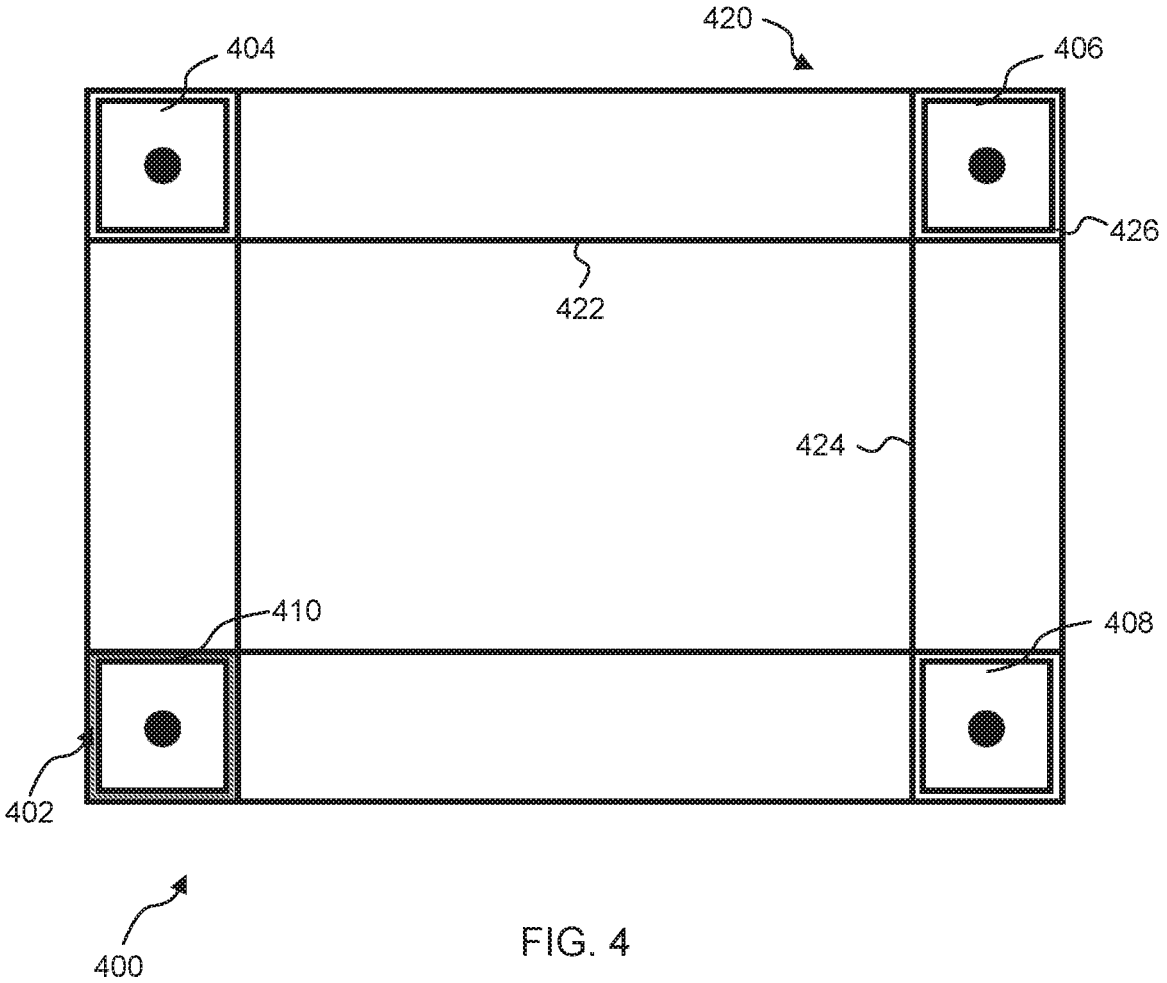
FIG. 4 is a bottom view schematic diagram of a pad, according to another example embodiment of the present disclosure.

FIG. 4 is an illustration of the underside of a pad 400 that has a leveling mechanism 402. The leveling mechanism 402 is similar to that of the leveling mechanism 121 of FIGS. 2 and 3. However, the leveling mechanism 402 includes four manual leveling legs 404, 406, 408 and 410 that can be screwed in or out to raise or lower the pad 400 to a level position. The pad 400 also has a support structure 420 that is different than the support structure 110 of FIG. 2 to illustrate that other support structures are possible. The support structure 420 includes horizontal ribs 422 and vertical ribs 424 that meet in the corners of the pad 400 to create pockets, such as pocket 426. The pocket 426 can then be used to press fit a leveling leg 406 into the pocket 426 to retain the leveling leg 406.

Figure 5:
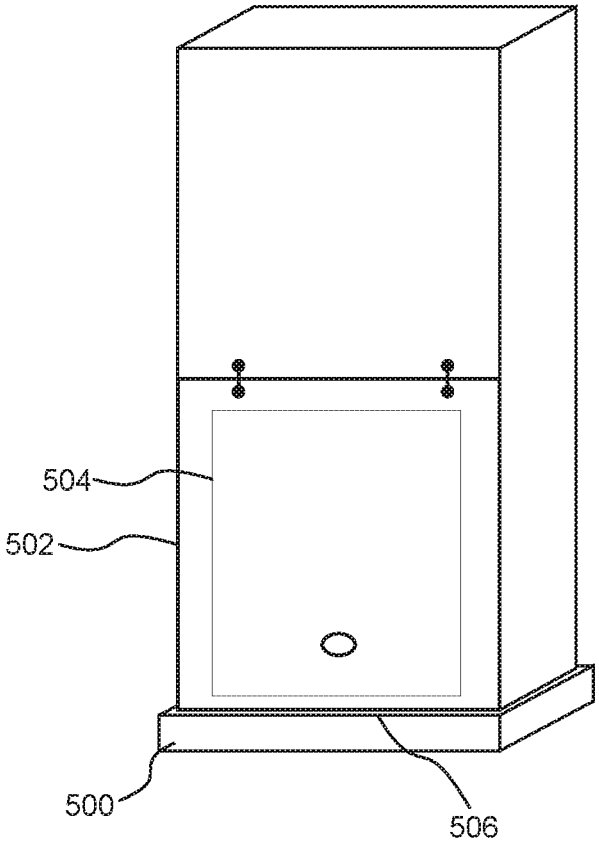
FIG. 5 is a perspective view diagram of a pad installed under a furnace according to one example embodiment of the present disclosure.

Referring to FIG. 5, FIG. 5 is a perspective view of a pad 500 with a furnace 502 installed on it. The furnace 502 could be screwed to the pad from the inside of the furnace 502 by taking the cover 504 off to allow access to the inside. In installation, the pad 500 would first be put in place, leveled into position, then the furnace 502 would be set on top of the pad 500. The furnace 502 can then be screwed down to the pad 500. Alternatively, the top surface 506 of the pad 500 could have a small lip around the periphery to prevent the furnace from vibrating off of the pad 500.

Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the present invention, disclosure, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A pad comprising:

a support structure for supporting a mechanical device, the support structure including horizontal ribs and vertical ribs that meet in the corners of the pad to form first, second, third and fourth integral pockets in each of the corners; and a leveling mechanism for leveling the pad, the leveling mechanism including first, second, third and fourth receivers that are press-fitted into the first, second, third and fourth pockets and including first, second, third and fourth leveling legs that screw into and out of the first, second, third and fourth receivers;

wherein during installation, an installer can press fit the first, second, third and fourth receivers into the first, second, third and fourth pockets and screw the first, second, third and fourth legs in and out of the receivers to level the pad.

2. The pad of claim 1, wherein the first, second, third and fourth leveling legs are removable from the pad.

3. The pad of claim 1, further comprising a cover having an acoustical quality attached to the horizontal layer of the support structure to reduce vibration and noise.

4. The pad of claim 1, wherein the leveling mechanism includes first and second leveling legs at a front of the pad and third and fourth leveling legs at the rear of the pad that are operable from the front of the pad such that during installation an installer can level the first and second front leveling legs and first and second rear leveling legs from the front side of the pad.

5. The pad of claim 1, wherein the pad comprises a plastic material.

6. The pad of claim 5, wherein the leveling mechanism comprises a plastic material.

7. The pad of claim 1, wherein the pad has a length between 20 and 40 inches and a width between 20 and 30 inches.

8. The pad of claim 1, wherein the pad has a length of 29.75 inches and a width of 24 inches.

9. The pad of claim 1, wherein the leveling mechanism includes first and second leveling legs at a front of the pad and third and fourth leveling legs at the rear of the pad that are operable from the front of the pad such that during installation an installer can level the first and second front leveling legs and first and second rear leveling legs from the front side of the pad.

10. The pad of claim 1, wherein the leveling mechanism includes first and second leveling legs at a front of the pad and third and fourth leveling legs at the rear of the pad that are operable from the front of the pad such that during installation an installer can level the first and second front leveling legs and first and second rear leveling legs from the front side of the pad.

* * * * *